US005944420A

United States Patent [19]

Petit

[11] Patent Number: 5,944,420

[45] Date of Patent: Aug. 31, 1999

[54] PLANT FOR MIXING AND PACKAGING LIQUID PRODUCTS

[75] Inventor: Daniel Petit, Paris, France

[73] Assignee: Elf Antar France, Courbevoie, France

[21] Appl. No.: 08/722,216

[22] PCT Filed: Feb. 19, 1996

[86] PCT No.: PCT/FR96/00262

§ 371 Date: Jan. 6, 1997

§ 102(e) Date: Jan. 6, 1997

[87] PCT Pub. No.: WO96/26001

PCT Pub. Date: Aug. 29, 1996

[30] Foreign Application Priority Data

Feb. 20, 1995 [FR] France ..... 95 01910

[51] Int. Cl.[6] ..... B01F 13/00; B01F 13/10

[52] U.S. Cl. ..... 366/349

[58] Field of Search ..... 366/62, 53, 131, 366/134, 150.1, 177.1, 208, 349, 14, 241; 52/79.1, 122.1, 127.1; 248/544, 146; 220/562, 563, 564, 475; 137/88, 87.01, 98, 315, 316

[56] References Cited

U.S. PATENT DOCUMENTS

| | | | |
|---|---|---|---|
| 3,142,390 | 7/1964 | Preeman . | |
| 3,767,170 | 10/1973 | Morgenstern . | |
| 3,999,741 | 12/1976 | Richards | 366/13 |
| 4,067,448 | 1/1978 | Bergeron, Jr. | 52/122.1 |
| 4,173,288 | 11/1979 | Schultz . | |
| 4,457,116 | 7/1984 | Kump | 52/79.1 |
| 4,715,721 | 12/1987 | Walker et al. | 366/134 |
| 4,782,973 | 11/1988 | Wiese . | |
| 4,792,234 | 12/1988 | Doherty | 366/14 |
| 4,854,714 | 8/1989 | Davis et al. | 366/17 |
| 4,913,554 | 4/1990 | Bragg et al. | 366/53 |
| 5,094,542 | 3/1992 | Englels et al. | 366/349 |
| 5,171,121 | 12/1992 | Smith et al. | 366/30 |
| 5,261,746 | 11/1993 | Boasso | 366/325.92 |
| 5,507,574 | 4/1996 | Dickey | 366/14 |

FOREIGN PATENT DOCUMENTS

| | | |
|---|---|---|
| 150395 | 12/1984 | European Pat. Off. . |
| 468827 | 6/1991 | European Pat. Off. . |
| 1584321 | 2/1970 | Germany . |
| 21591 | 12/1992 | WIPO . |

*Primary Examiner*—Tony G. Soohoo

*Attorney, Agent, or Firm*—Oblon, Spivak, McClelland, Maier & Neustadt, P.C.

[57] ABSTRACT

Apparatus for mixing and packaging liquid materials, comprising a number of assemblies which in turn include a number of modules, each mounted on a frame for lifting, transporting and positioning the associated module.

19 Claims, 5 Drawing Sheets

PLANT FOR MIXING AND PACKAGING LIQUID PRODUCTS

TECHNICAL FIELD

The present invention relates to a plant for manufacturing and packaging liquid products, by mixing liquid- and/or powder-based constituents.

It finds application in particular for the manufacture of lubricants, by mixing petroleum-derived base oils and additives, and their packaging for the purpose of selling them.

It also finds application for the manufacture of products stemming from the agrifood industry, for example drinks, and more generally for the manufacture of liquids made by mixing liquid and/or solid constituents and their packaging, in order to sell them, in containers such as bottles, cans and barrels.

PRIOR ART

Many plants have been produced for manufacturing and packaging liquid products by mixing liquid- and/or powder-based constituents.

These plants, generally associated with a station for storing basic constituents, include:

a production unit comprising vessels for mixing the basic constituents, means for transferring these constituents and means for metering them;

a packaging unit comprising vessels for storing end products and packaging machines which automatically fill empty tanks;

a services production unit comprising means for producing heat and compressed air and water treatment means.

The equipment, such as the mixing vessels, the tanks and the storage vessels, are generally manufactured on the site of use in order to avoid the difficult and expensive operation of shipping them.

The reason for this is that this equipment, of cylindrical shape with a vertical or horizontal axis, which is provided with supporting means, fittings for the passage of filling and emptying pipework and, in the event of spillage, liquid-retaining means, cannot be mounted in standard freight containers or metal boxes of standardized dimensions in order to ship them. They are therefore exposed to degradation while they are being shipped and handled. In order to reduce the risk of degradation, expensive special tanks must be produced and special handling means must be employed.

The packaging machines are complicated site-mounted equipment always requiring, after assembly, difficult adjustment operations.

The equipment constituting the transfer means, the metering means, the steam and compressed-air production means and the water treatment means are manufactured in various separate locations away from the site of use. They must be shipped either by special transporters or by taking special packaging precautions in order to prevent them from becoming damaged.

All this equipment making up the units is integrated into metal and/or concrete supports which are suitable for a fixed and definitively installed plant and therefore cannot be shipped to another site. They are linked together hydraulically by many rigid pipes having the same length and electrically by cables connected to terminals in electrical housings which are directly fixed to them.

Such plants require work to be carried out by specialized labour on the sites of exploitation. In many geographical regions, such labour is not available. In this case, it is necessary for overseas technicians to carry out work far from their technical bases in order to construct the plants, mount the equipment and provide the start up operations. The cost of such work is very high.

For economic or contractual reasons, it may be necessary to stop the use of a plant which is in perfect running order.

The plants described hereinabove have the drawback of not being able to be taken down on a given site and re-erected on another site under conditions which are economically acceptable, especially because of their many non-disconnectable mechanical, hydraulic and electrical links to the external environment.

They also have the drawback of not lending themselves easily to variations in production and packaging capacity.

DESCRIPTION OF THE INVENTION

The object of the present invention is precisely to remedy these drawbacks and, in particular, to provide a plant for mixing and packaging liquid products which is modular, capable of being shipped completely safely by ordinary means, and can be taken down and re-erected inexpensively.

To these ends, the invention provides a plant for mixing and packaging liquid products, which includes a production unit, a packaging unit and a services production unit, each unit comprising several modules, characterized in that each module is mounted on an associated support frame intended to enable it to be lifted, shipped and installed.

According to a preferred embodiment of the invention, at least one associated support frame is a space structure having mutually connected bars, comprising a base and an upper frame connected together by posts.

By virtue of its characteristics, the plant may be produced and tested in a geographical region where the specialized labour necessary for these operations is available and in a modern industrial environment conducive to cost reduction—powerful lifting means, production control, integration of all special functions, and quality assurance.

Given that the plant consists of juxtaposed and/or stacked modules, it can be shipped from the site of manufacture to the site of exploitation without using special shipping means.

The bar-type space structure on which each module is mounted ensures that the equipment is effectively protected while it is being shipped and handled.

The modules can be assembled on the site of exploitation by non-specialized workers extremely quickly.

The modules require few links to the external environment and, in particular, they avoid having major foundations as the load is distributed over the ground.

The bar-type space structure supporting each module ensures that each item of equipment is correctly positioned in the units and that this positioning is reproduced in a removal situation.

Sectioning the units of the plant into modules, providing a specific function, makes it is possible to remove or add a module in order to modify the capacity of the plant, either in production or in packaging. In addition, since the plant can be taken down and re-erected easily, it may be moved from one site to another at less cost.

According to another characteristic of the invention, the associated support frames are mechanically joined together by disconnectable rigid means.

The invention also comprises:

between the various modules, electrical connections formed by means of cables, each of them being provided with at least one marked plug-in connector equipped with a security device;

between each module and each unit, hydraulic connections formed by means of hoses provided with fittings enabling them to be disconnected and reconnected.

According to another characteristic, the hydraulic links between the modules are formed by means of rigid pipes provided with connection flanges positioned at the boundary of the said modules.

According to another characteristic, the posts of at least one space structure have an adjustable length making it possible to adjust the height of the said structure.

According to another characteristic of the invention, at least one module of one of the units is a liquid tank which has two opposite vertical walls forming an associated support frame, each wall being provided with two horizontal rims, respectively the upper and lower rims, a horizontal roof placed between the vertical walls under the upper horizontal rims, a V-shaped bottom placed between the vertical walls above the lower horizontal rims, the roof and the bottom having the same length, this length being less than the length of the vertical walls, and two vertical end panels placed between the vertical walls, the roof, the bottom, the vertical walls and the end panels being connected so as to delimit a closed space intended to accommodate the liquid, the roof and the bottom having openings provided with pipework elements in order to enable the tank to be filled and emptied, the vertical ends and the horizontal rims of the vertical walls protecting the pipework elements, and the upper horizontal rims being provided with means for lifting the module.

According to another characteristic of the invention at least one liquid tank furthermore includes at least one internal vertical partition arranged so as to constitute a tank having at least two compartments, each of them having filling and emptying pipework elements.

According to another characteristic of the invention the vertical end panels are equipped at the top with extension pieces connected to the vertical ends and to the upper horizontal rims of the vertical walls so as to form a liquid-retaining volume, in the event of spillage from the tank.

According to a final characteristic of the invention, the lower ends and the lower horizontal rims of the vertical walls of at least one tank function as a support for the said tank and include means for fixing the said tank.

BRIEF DESCRIPTION OF THE DRAWINGS

The invention will more easily be understood with the help of the following description of an embodiment given by way of example, and with reference to the appended drawings in which.

DETAILED DESCRIPTION OF THE INVENTION

In general, the plant forming the subject of the invention is used to manufacture and package liquid products. It is particularly suitable for the manufacture of lubricants obtained by mixing base oils and additives. The products resulting from the mixing are packaged in order to be sold.

Figure 1:
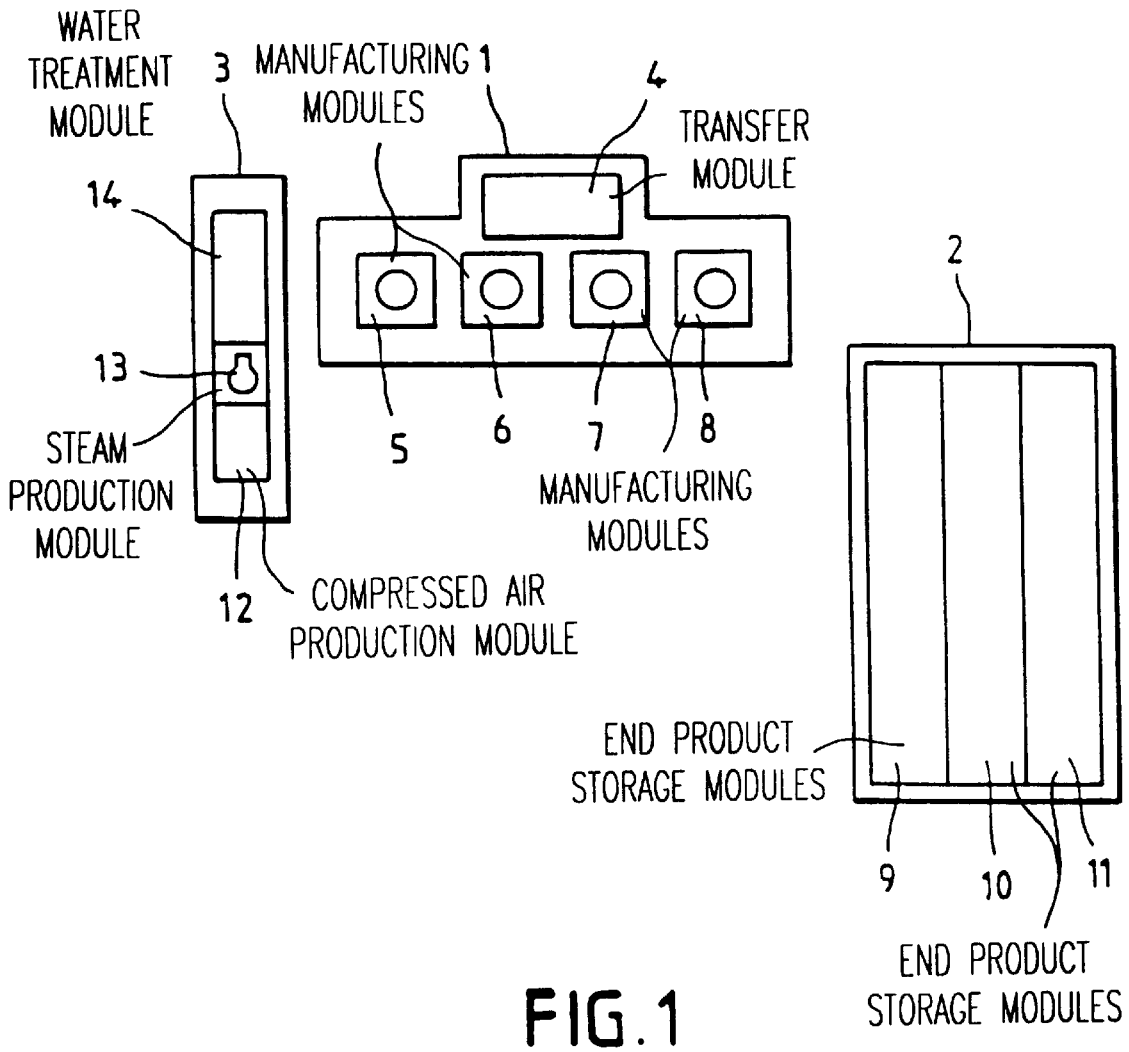
FIG. 1 represents diagrammatically a plant for manufacturing and packaging lubricants.

According to the embodiment shown in FIG. 1, the plant includes three units:

a production unit 1 comprising a transfer module 4, a metering module, not shown, and four manufacturing modules 5, 6, 7, 8;

a packaging unit 2 comprising three modules 9, 10 and 11 for storage of end products and three packaging modules, not shown, located beneath the modules 9, 10 and 11; and a services production unit 3 comprising a compressed-air production module 12 and an oven, a steam production module 13 and a water treatment module 14.

Each of these modules, which defines a specific function, is mounted on a support frame comprising, in the example illustrated, a space structure having connected bars, this structure being produced from metal sections enabling it, using conventional means, to be lifted without permanent deformation, to be shipped and to be installed on a site of exploitation.

Figure 2:
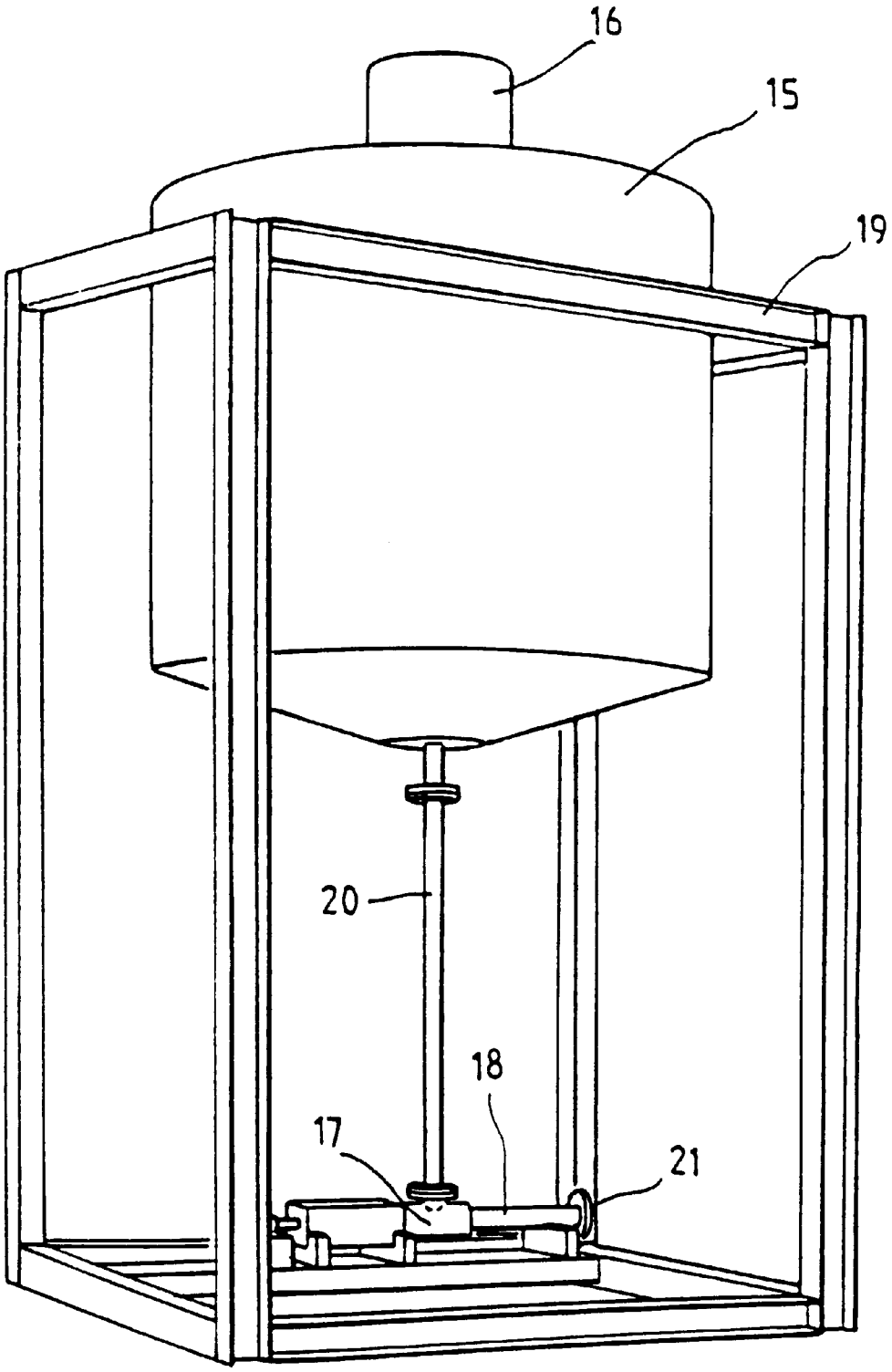
FIG. 2 represents diagrammatically one module of a production unit of a plant for manufacturing lubricants, supported by a space frame.

By way of example, FIG. 2 shows a production module comprising a functional component including a mixing vessel 15, a stirrer motor 16, a pump for draining the product manufactured in the vessel 15, a pipe 20 for connecting the vessel 15 to the intake of the pump 17, a pipe 18 for the delivery of the pump 17 and a support frame 19 consisting of a space structure having connected bars. Not shown in this figure are other elements of the production module, in particular the means for mechanically connecting the vessel 15 to the support frame 19, and lifting means which make handling easier.

The dimensions of each support frame are, on the one hand, adapted to the size of the equipment which it supports and, on the other hand, are limited by the maximum dimensions acceptable by conventional shipping means. By way of example, for standard freight containers for shipping by water, the dimensions of the elements which may be shipped are 2.3 m in width, 2.3 m in height and 5.9 or 12 m in length.

According to another characteristic, the support frames supporting the modules of any one unit are mechanically connected together by means which ensure that the connections are rigid and that the modules are correctly positioned with respect to one another, and which allow the said modules to be stacked and juxtaposed.

By way of non-limiting example, it is possible to mention nuts, bolts and positioning feet. These rigid connections improve the rigidity of the units. Without them, it would be necessary to strengthen the support frames by means of gusset plates which would impede accessibility to the equipment and the movement of operators.

According to another characteristic of the invention, the electrical connections between the various modules are formed by means of cables, each of them being provided with a marked plug-in connector equipped with a security device.

The connections of the cables to the terminals of the junction boxes of the equipment, the electrical cabinets and the connectors are made on the site of construction by specialists. By virtue of these connectors, the modules can be rapidly disconnected and reconnected by non-specialists with minimum risk of reconnection error.

The hydraulic connections carrying various fluids, base products and additives are formed by means of hoses provided with fittings enabling them to be rapidly disconnected and reconnected by non-specialists. These hydraulic connections are also formed by means of rigid pipes provided with connection flanges in order to enable them to be disconnected. These flanges are positioned at the boundaries of the modules, like the flange 21 shown in FIG. 2.

As we have just seen, all the mechanical connections between the modules are disconnectable. This characteristic ensures the reproducibility of successive installations.

According to another characteristic, at least one space structure having mutually connected bars, which is associated with a module, comprises a base and an upper frame which are joined by posts of adjustable length.

This characteristic is particularly advantageous for producing modules in which the height in use is defined in order to allow the passage of operators, it being possible for this height to be reduced during handling and transfer operations in order to decrease the overall size of the module.

Figure 3:
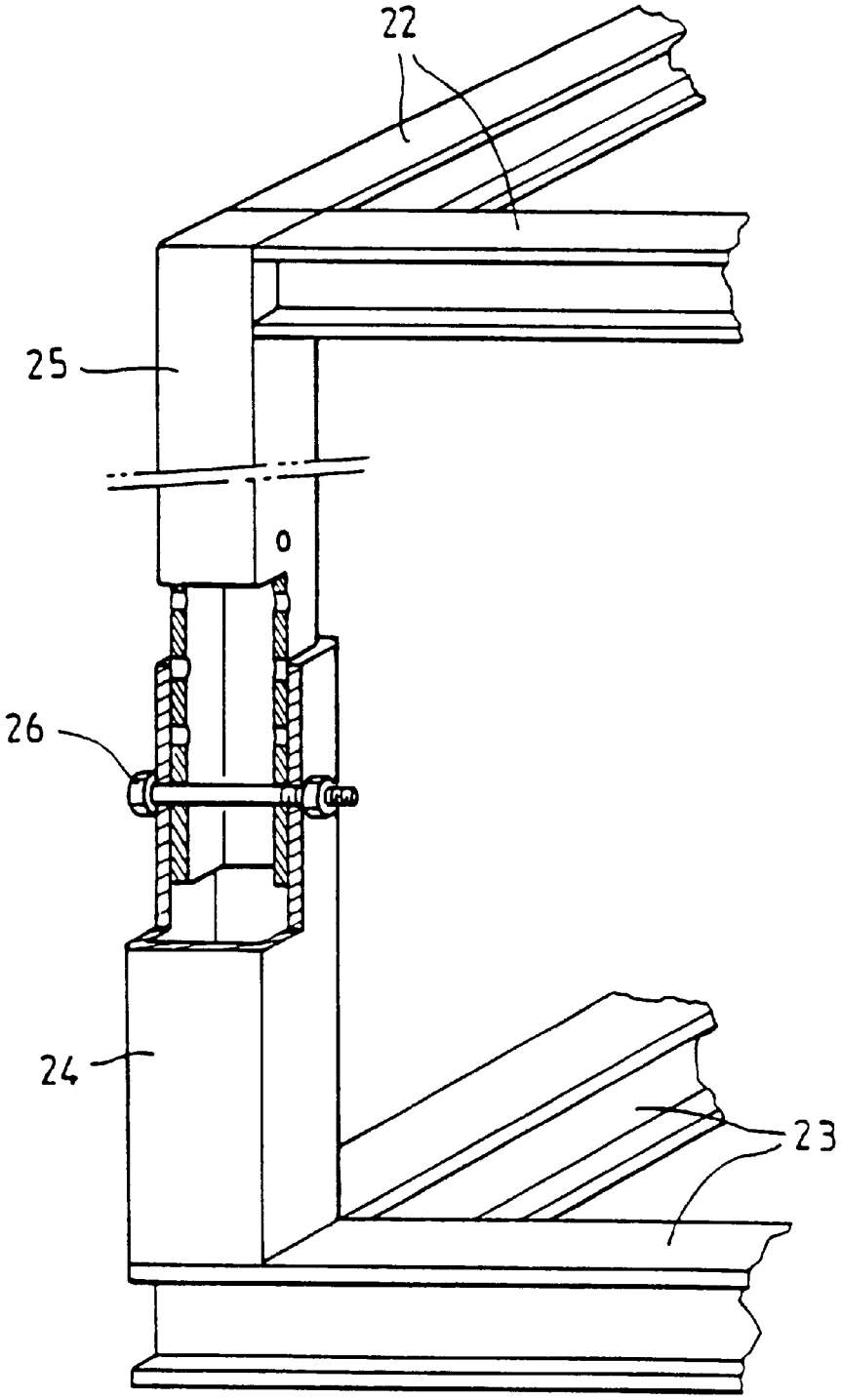
FIG. 3 represents diagrammatically a space frame having mutually connected bars, the posts of which have adjustable lengths.

By way of example, FIG. 3 shows a metal space structure having mutually connected bars, comprising a base 23, an upper frame 22, a post in two sliding parts 24 and 25 and a device 26 for locking these sliding parts 24 and 25 in position.

Figure 4:
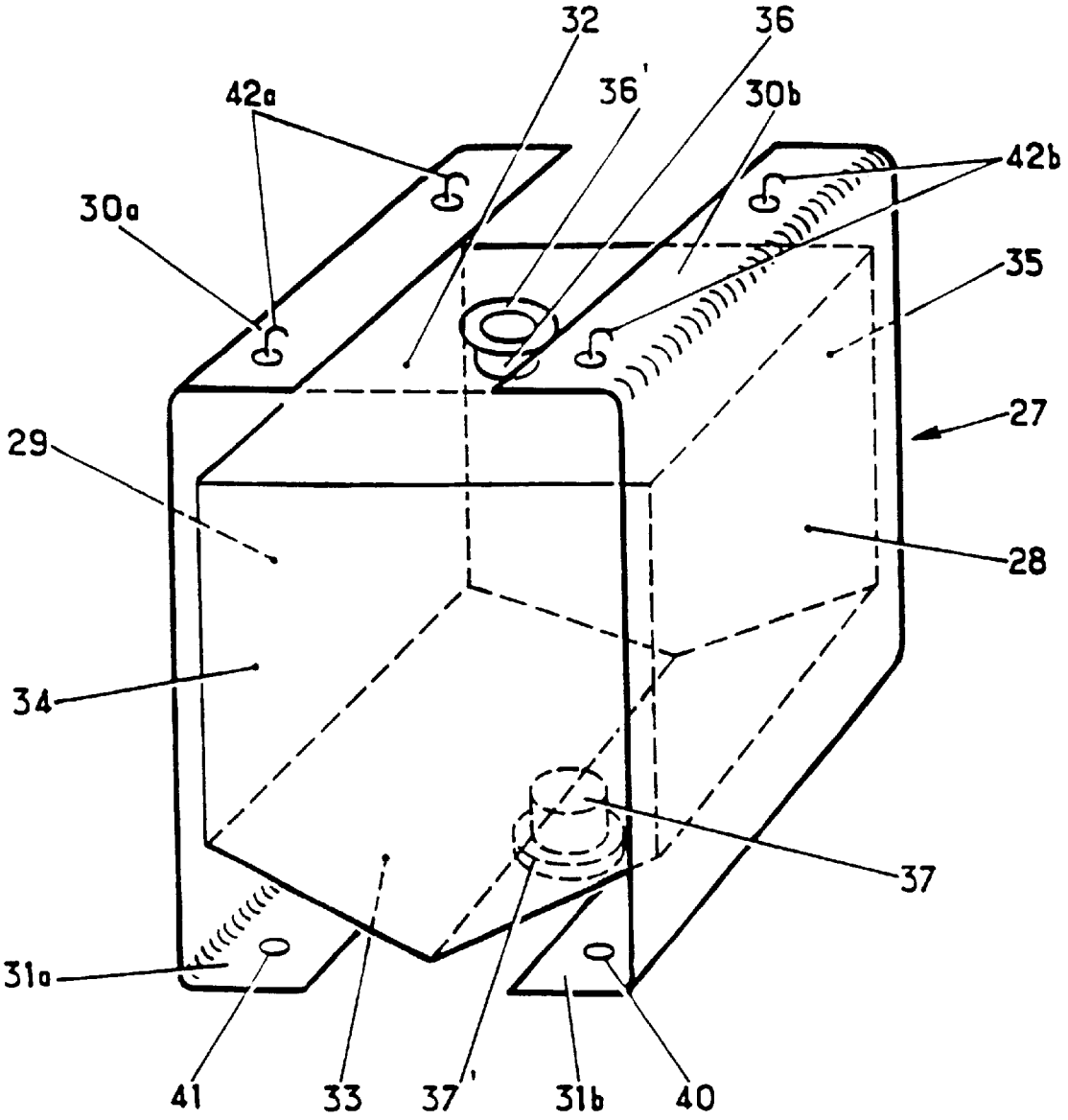
FIG. 4 represents diagrammatically a liquid tank which can be shipped by a standard freight container.

According to another characteristic of the invention, a module for storing an end product comprises a tank shown in FIG. 4.

This tank has:

two opposite vertical walls 28 and 29 each provided with two horizontal rims 30*a,* 30*b* and 31*a,* 31*b;* a roof 32;

a bottom 33;

two end panels 34 and 35;

openings 36 and 37;

pipework elements 36' and 37';

lifting means 42*a* and 42*b;* and fixing means 40 and 41.

The two walls 28 and 29, the roof 32, the bottom 33 and the two panels are produced from stainless steel sheets welded together in order to form a closed space intended to accommodate the end product to be stored.

The tank thus formed is filled and/or emptied through pipework elements 36' and 37' joined to the openings 36 and 37 by welds.

The disconnectable lifting means 42*a* and 42*b* arranged on the upper rims 30*a* and 30*b* make it easy both to handle the tank and to install it on the site of use. Because of the shape thus obtained, the tank can be shipped by a standard freight container without special expensive packaging. The pipework elements 36' and 37' are well protected from shocks during handling of the tank.

The roof 32 and the bottom 33 have a length which is less than that of the walls 28 and 29, and the end panels 34 and 35 have a height less than that of the walls 28 and 29 so that these elements 32, 33, 34 and 35, as well as the pipework elements 36' and 37', are protected from shocks by the vertical walls 28 and 29 and their horizontal rims 30*a,* 30*b,* 31*a* and 31*b*. The unit thus formed is suitably rigid, allowing it to be handled and shipped without any special precaution.

The lower rims 31*a* and 31*b* form a surface for the tank to bear on a plane structure to which it may be fixed, for example by means of nuts and bolts through the holes 40 and 41.

Several tanks may be mounted beside each other in order to obtain a given storage capacity adapted to the requirements of the plant.

Accessories, such as indicators showing the level of liquid in the tank and ladders for gaining access to the roof, may be fitted onto the external faces of the end panels 34 and 35. These accessories will be protected by the vertical walls 28 and 29.

The roof 32 has a plane shape, but it could be domed.

The bottom 33 has a very open V-shaped section, given by way of example, to make it easier for the liquid to flow through the opening 37 in its lower part, but other shapes such as a domed or pyramid shape are possible.

Figure 5:
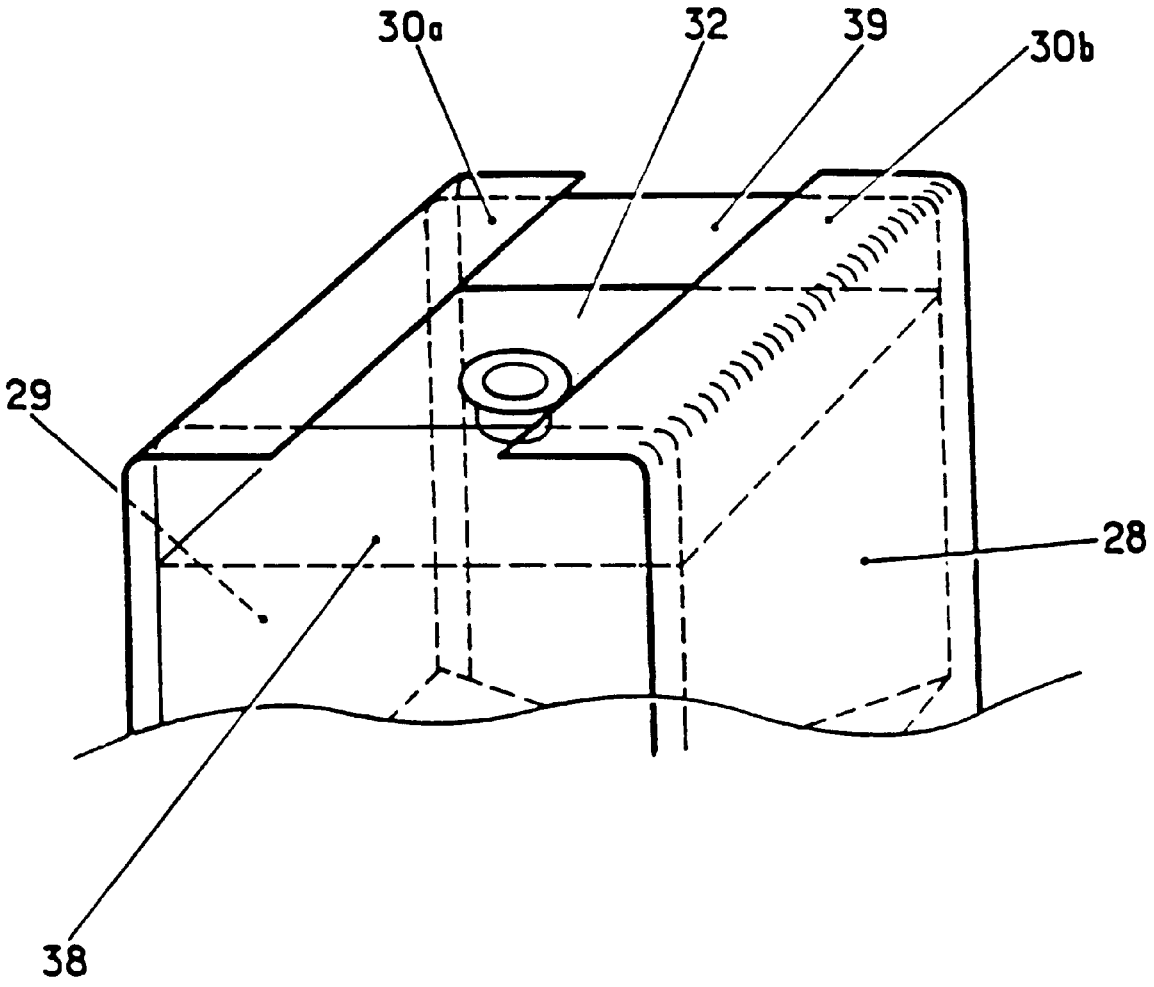
FIG. 5 represents the upper part of a liquid tank which can be shipped by a freight container, having a liquid-retaining volume in the event of spillage from the tank.

FIG. 5 shows the upper part of a tank which includes extension pieces 38 and 39 extending the end panels 34 and 35, these end pieces being welded to the walls 28 and 29 and to the upper horizontal rims 30*a* and 30*b*.

By virtue of these arrangements, a liquid-retaining space is created above the roof 32. In the event of spillage from the tank during a filling operation, the liquid is retained in this space.

I claim:

1. Plant for mixing and packaging liquid products, said plant including a production unit, a packaging unit and a services production unit, each aid unit comprising several modules, said modules including a functional component which is able to cooperate with other functional components of the plant to further mixing and packaging of a product, and a support frame mounting said functional component and comprising means for enabling the functional component to be lifted, shipped and installed, said modules including a mixing module having a mixing vessel in said production unit and a module for storing an end product in said packaging unit.

2. Plant according to claim 1, characterized in that at least one associated support frame is a space structure having mutually connected bars, comprising a base and an upper frame connected together by posts.

3. Plant according to claim 2, characterized in that the posts of at least one space structure have adjustable lengths making it possible to adjust the height of the said structure.

4. Plant according to claim 2, characterized in that the associated support frames are mechanically joined together by disconnectable rigid means.

5. Plant according to claim 2, characterized in that it comprises, between each module and each unit, hydraulic links formed by means of hoses provided with fittings enabling them to be disconnected and reconnected.

6. Plant according to claim 1 characterized in that the associated support frames are mechanically joined together by disconnectable rigid means.

7. Plant according to claim 6, characterized in that it comprises, between each module and each unit, hydraulic links formed by means of hoses provided with fittings enabling them to be disconnected and reconnected.

8. Plant according to claim 6, characterized in that the posts of at least one space structure have adjustable lengths making it possible to adjust the height of the said structure.

9. Plant according to claim 1, characterized in that it comprises, between each module of each unit, hydraulic links formed by means of hoses provided with fittings enabling them to be disconnected and reconnected.

10. Plant according to claim 9, characterized in that the hydraulic links between the modules are formed by means of rigid pipes provided with connection flanges positioned at the boundary of the said modules.

11. Plant accordingly to claim 9, characterized in that the posts of at least one space structure have adjustable lengths making it possible to adjust the height of the said structure.

12. Plant according to claim 1, characterized in that at least one functional component of one of the said units is a liquid tank which has two opposite vertical walls forming the associated support frame, each wall being provided with two horizontal rims, respectively the upper and lower rims, a horizontal roof placed between the vertical walls under the upper horizontal rims, a V-shaped bottom placed between the vertical walls above the lower horizontal rims, the roof and the bottom having the same length, this length being less than the length of the vertical walls, and two vertical end panels placed between the vertical walls, the roof, the bottom, the vertical walls and the end panels being connected so as to delimit a closed space intended to accommodate the liquid, the roof and the bottom having openings provided with pipework elements in order to enable the said tank to be filled and emptied, the vertical ends and the horizontal rims of the vertical walls protecting the pipework elements, and the upper horizontal rims being provided with means for lifting the module.

13. Plant according to claim 12, characterized in that the vertical end panels are equipped at the top with extension pieces connected to the vertical ends and to the upper horizontal rims of the vertical walls so as to form a liquid-retaining volume, in the event of spillage from the tank.

14. Plant according to claim 12, characterized in that the lower ends and the lower horizontal rims of the vertical walls of at least one tank function as a support for the said tank and include means for fixing the said tank.

15. A plant for mixing and packaging liquid products, said plant including a production unit, a packaging unit and a services production unit, each said unit comprising several modules, said modules including a functional component which is able to cooperate with other functional components of the plant to further mixing and packaging of a product, and a support frame mounting said functional component and comprising means for supporting and protecting the functional component during shipping, for correctly positioning the functional component, and for facilitating the assembly of the modules to form the units, said modules including a mixing module having a mixing vessel in said production unit and a module for storing an end product in said packaging unit.

16. Plant according to claim 12, characterized in that it comprises, between each module and each unit, hydraulic links formed by means of hoses provided with fittings enabling them to be disconnected and reconnected.

17. Plant according to claim 12, characterized in that the posts of at least one space structure have adjustable lengths making it possible to adjust the height of the said structure.

18. The plant of claim 15, wherein said support frame encloses said functional component and has at least one lifting hook.

19. The plant of claim 15, wherein said support frame includes posts having adjustable lengths.

* * * * *